US012473118B2

(12) United States Patent
Kavanagh

(10) Patent No.: US 12,473,118 B2
(45) Date of Patent: Nov. 18, 2025

(54) TRAY AND SLEEVE WITH LOCKING FEATURES, RELATED SYSTEMS AND METHODS

(71) Applicant: Graphic Packaging International, LLC, Atlanta, GA (US)

(72) Inventor: Marc Kavanagh, Kent (GB)

(73) Assignee: Graphic Packaging International, LLC, Atlanta, GA (US)

( * ) Notice: Subject to any disclaimer, the term of this patent is extended or adjusted under 35 U.S.C. 154(b) by 80 days.

(21) Appl. No.: 18/237,425

(22) Filed: Aug. 24, 2023

(65) Prior Publication Data

US 2024/0067388 A1 Feb. 29, 2024

Related U.S. Application Data

(60) Provisional application No. 63/400,923, filed on Aug. 25, 2022.

(51) Int. Cl.

| | |
|---|---|
| ***B65D 5/38*** | (2006.01) |
| ***B65D 5/04*** | (2006.01) |
| ***B65D 5/10*** | (2006.01) |
| ***B65D 5/20*** | (2006.01) |

(52) U.S. Cl.

CPC ..... *B65D 5/38* (2013.01); *B65D 5/04* (2013.01); *B65D 5/10* (2013.01); *B65D 5/20* (2013.01)

(58) Field of Classification Search

CPC . B65D 5/503; B65D 5/20; B65D 5/10; B65D 5/04; B65D 5/38; B65D 2215/02; A61J 1/035

USPC ..... 206/1.5, 538, 528, 531

See application file for complete search history.

(56) References Cited

U.S. PATENT DOCUMENTS

| | | | | |
|---|---|---|---|---|
| 10,017,291 | B2 * | 7/2018 | Smith | B65D 5/728 |
| 11,365,022 | B2 * | 6/2022 | Altman | B65D 43/20 |
| 2016/0152373 | A1 * | 6/2016 | Linssen | B65D 5/38 206/1.5 |
| 2016/0251107 | A1 * | 9/2016 | Everett | B65D 5/38 206/1.5 |
| 2019/0062023 | A1 * | 2/2019 | Lantz | B65D 77/0433 |

(Continued)

FOREIGN PATENT DOCUMENTS

| | | |
|---|---|---|
| CN | 109071064 A | 12/2018 |
| EP | 3 623 308 A1 | 3/2020 |

OTHER PUBLICATIONS

International Search Report and Written Opinion for PCT/US2023/030996 dated Dec. 13, 2023.

*Primary Examiner* — Steven A. Reynolds

(74) *Attorney, Agent, or Firm* — Andrew N. Claerbout; FisherBroyles, LLC

(57) ABSTRACT

A system for holding one or more articles includes a tray and a sleeve for at least partially receiving the tray. The tray includes a plurality of panels at least partially extending around an interior of the tray and including a bottom panel, at least one side panel, and at least one end panel, a plurality of end flaps, and locking features including at least one locking flap foldably connected to a respective end flap of the plurality of end flaps, at least a portion of the at least one locking flap extending away from the tray. The sleeve includes a plurality of panels extending at least partially around an interior of the sleeve, at least one panel of the plurality of panels of the sleeve having a locking opening for at least partially receiving the at least a portion of the at least one locking flap.

34 Claims, 6 Drawing Sheets

(56) References Cited

U.S. PATENT DOCUMENTS

| | | | | |
|---|---|---|---|---|
| 2020/0087020 | A1* | 3/2020 | Tsai | B65D 59/04 |
| 2021/0016939 | A1* | 1/2021 | Palmer | B65D 5/38 |
| 2021/0053715 | A1 | 2/2021 | Tsai et al. | |
| 2021/0171235 | A1* | 6/2021 | Boland | B65D 5/38 |
| 2022/0063877 | A1* | 3/2022 | Forenza | B65D 5/38 |
| 2022/0204210 | A1* | 6/2022 | Joines | B65D 5/38 |
| 2022/0289425 | A1* | 9/2022 | Green | B65D 5/38 |

* cited by examiner

TRAY AND SLEEVE WITH LOCKING FEATURES, RELATED SYSTEMS AND METHODS

CROSS-REFERENCE TO RELATED APPLICATION

This application claims the benefit of U.S. Provisional Patent Application No. 63/400,923, filed on Aug. 25, 2022.

INCORPORATION BY REFERENCE

The disclosure of U.S. Provisional Patent Application No. 63/400,923, filed on Aug. 25, 2022, is hereby incorporated by reference for all purposes as if set forth herein in its entirety.

BACKGROUND

The present disclosure generally relates to containers for holding one or more articles. More specifically, the present disclosure relates to trays for holding one or more articles and that include locking features for engaging an outer sleeve.

SUMMARY

According to one aspect, the disclosure is generally directed to a system for holding one or more articles, the system comprising a tray and a sleeve for at least partially receiving the tray, the tray comprising a plurality of panels at least partially extending around an interior of the tray, the plurality of panels comprising a bottom panel, at least one side panel, and at least one end panel, a plurality of end flaps foldably connected to a respective panel of the plurality of panels of the tray, and locking features comprising at least one locking flap foldably connected to a respective end flap of the plurality of end flaps, at least a portion of the at least one locking flap extending away from the tray. The sleeve comprises a plurality of panels extending at least partially around an interior of the sleeve, at least one panel of the plurality of panels of the sleeve comprising a locking opening for at least partially receiving the at least a portion of the at least one locking flap.

According to another aspect, the disclosure is generally directed to a combination of blanks for forming a system for holding one or more articles, the combination of blanks comprising a tray blank and a sleeve blank, the tray blank comprising a plurality of panels for at least partially extending around an interior of the tray formed from the tray blank, the plurality of panels comprising a bottom panel, at least one side panel, and at least one end panel, a plurality of end flaps foldably connected to a respective panel of the plurality of panels of the tray, and locking features comprising at least one locking flap foldably connected to a respective end flap of the plurality of end flaps, at least a portion of the at least one locking flap for extending away from the tray formed from the blank. The sleeve blank comprises a plurality of panels for extending at least partially around an interior of the sleeve formed from the sleeve blank for at least partially receiving the tray formed from the tray blank, at least one panel of the plurality of panels of the sleeve blank comprising a locking opening for at least partially receiving the at least a portion of the at least one locking flap.

According to another aspect, the disclosure is generally directed to a method of forming a system for holding one or more articles, the method comprising obtaining a tray blank, the tray blank comprising a plurality of panels comprising a bottom panel, at least one side panel, and at least one end panel, a plurality of end flaps foldably connected to a respective panel of the plurality of panels of the tray, and locking features comprising at least one locking flap foldably connected to a respective end flap of the plurality of end flaps. The method further comprises obtaining a sleeve blank, the sleeve blank comprising a plurality of panels, at least one panel of the plurality of panels of the sleeve blank comprising a locking opening, positioning the plurality of panels of the tray blank extending at least partially around an interior of the tray, positioning the locking features of the tray blank such that at least a portion of the at least one locking flap extends away from the tray, and positioning the plurality of panels of the sleeve blank extending at least partially around an interior of the sleeve such that the interior of the sleeve is positioned for at least partially receiving the tray, and such that the locking opening is positioned for at least partially receiving the at least a portion of the at least one locking flap.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to containers such as trays/sleeves, constructs, cartons, carriers, clips, or the like, and packages for shipping and dispensing articles that hold one or more articles such as personal care items (e.g., soaps, lotions, cosmetics, medicinal products, rinses such as mouthwash, etc.), household products (e.g., soap, hand or surface sanitizer, etc.), food products, or other articles. As described herein, such articles can be provided within a dedicated packaging, or the containers described herein can be configured to directly hold the material associated with such products.

It will be understood that it may be desirable to restrict access to some articles, which can include those to be disposed in containers described herein, by particular users. In some cases, these users can be children or other individuals whom parents/guardians/providers of consumer products may wish to avoid providing unduly easy access to articles such as those that provide a choking hazard, sweets or other indulgences, nonfood products that may be accidentally ingested, etc. At the same time, it is desirable to provide restricted access to contained articles to such selected individuals or groups of individuals while maintaining a suitable ease of access to intended end users of such articles. Accordingly, there is a need for a container solution that provides access restricting features while maintaining general ease of use for intended end users.

Containers according to the present disclosure can accommodate articles of any shape. For the purpose of illustration and not for the purpose of limiting the scope of the disclosure, the following detailed description describes product holding containers (e.g., paperboard trays and sleeves). In this specification, the terms "inner," "interior," "outer," "exterior," "lower," "bottom," "upper," and "top" indicate orientations determined in relation to fully erected and upright trays and sleeves.

As described herein, containers may be formed by multiple overlapping panels, end flaps, and/or other portions of blanks. Such panels, end flaps, and/or other portions of the blanks can be designated in relative terms to one another, e.g., "first", "second", "third", etc., in sequential or non-sequential reference, without departing from the disclosure.

Figure 1:
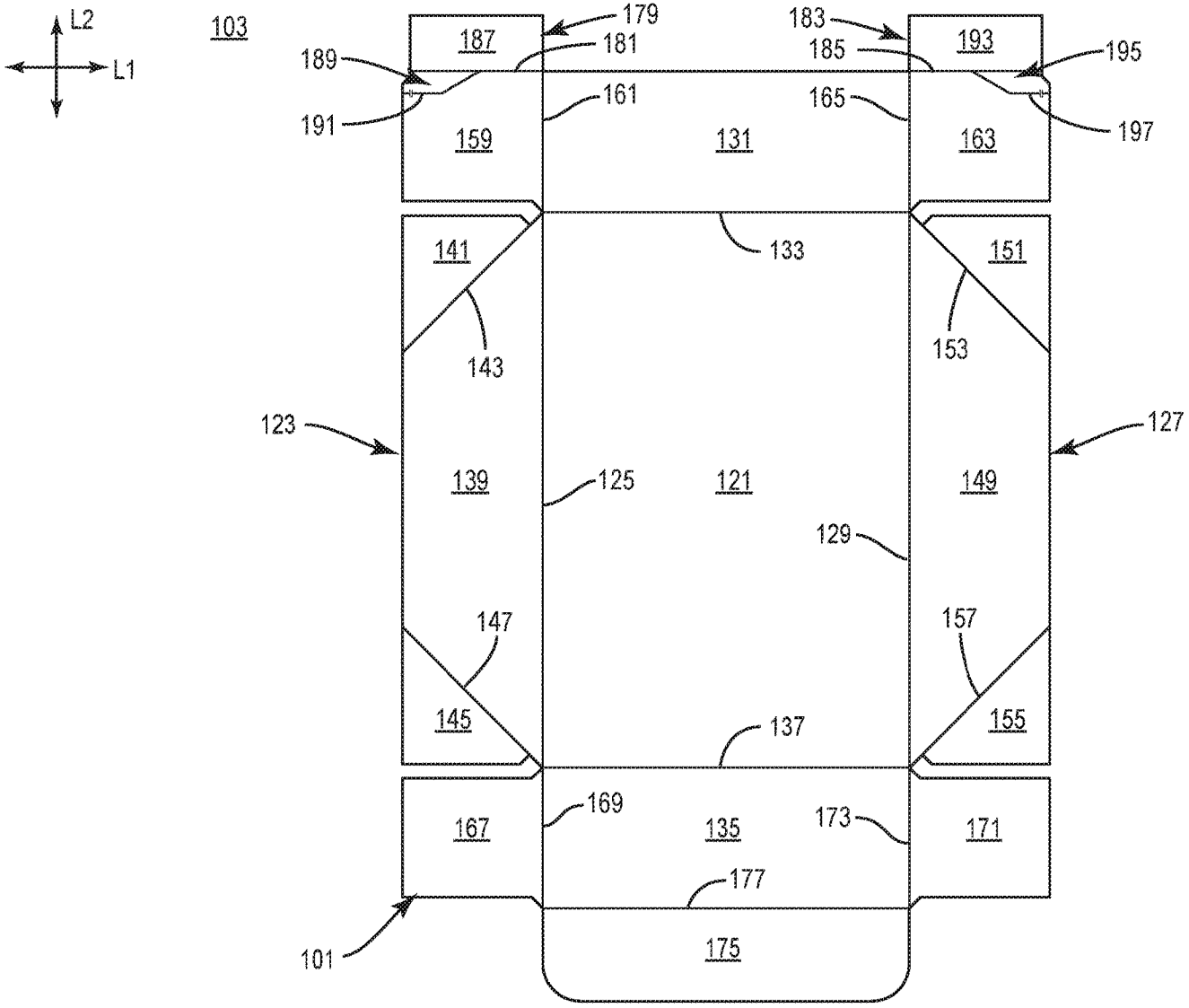
FIG. 1 is a plan schematic view of a tray blank for forming a tray according to an exemplary embodiment of the disclosure.

FIG. 1 is a plan view of an exterior surface 101 of a blank 103 used to form a tray 105 (FIG. 2) according to an exemplary embodiment of the present disclosure. The tray 105 defines an interior 107 within which one or more articles can be held. As described further herein, the tray 105 is configured to be at least partially received in the interior 307 of an outer carton or sleeve 305 (FIG. 2), each provided with corresponding locking features to provide a secure/locking engagement therebetween. The tray 105 and sleeve 305 can be provided together to form a system 100.

As shown, the tray blank 103 has a longitudinal axis L1 and a lateral axis L2. It will be understood that, in some embodiments, the longitudinal axis L1 and lateral axis L2 can be transposed.

The tray blank 103 has a plurality of panels for at least partially extending around the interior 107 of the tray 105. The plurality of panels can include a bottom panel 121, a first side panel 123 foldably connected to the bottom panel 121 at a lateral fold line 125, a second side panel 127 foldably connected to the bottom panel 121 at a lateral fold line 129, a first end panel 131 foldably connected to the bottom panel 121 at a longitudinal fold line 133, and a second end panel 135 foldably connected to the bottom panel 121 at a longitudinal fold line 137.

As shown, the first side panel 123 can include a base portion 139 foldably connected to the bottom panel 121 at the fold line 125, a first distal portion 141 foldably connected to the base portion 139 at an oblique fold line 143, and a second distal portion 145 foldably connected to the base portion 139 at an oblique fold line 147.

Similarly, the second side panel 127 can include a base portion 149 foldably connected to the bottom panel 121 at the fold line 129, a first distal portion 151 foldably connected to the base portion 149 at an oblique fold line 153, and a second distal portion 155 foldably connected to the base portion 149 at an oblique fold line 157.

The tray blank 103/tray 105 can also include a plurality of end flaps foldably connected to a respective panel of the plurality of panels. In the illustrated embodiment, a first attachment flap 159 can be foldably connected to the first end panel 131 at a lateral fold line 161, a second attachment flap 163 can be foldably connected to the first end panel 131 at a lateral fold line 165, a third attachment flap 167 can be foldably connected to the second end panel 135 at a lateral fold line 169, and a fourth attachment flap 171 can be foldably connected to the second end panel 135 at a lateral fold line 173. An end flap 175 can also be foldably connected to the second end panel 135 at a longitudinal fold line 177.

The end flaps can further include a first locking flap 179 foldably connected to the attachment flap 159 at a respective portion of a longitudinal fold line 181 and a second locking flap 183 foldably connected to the attachment flap 163 at a respective portion of a longitudinal fold line 185.

As shown, the first locking flap 179 can include a base portion 187 foldably connected to the attachment flap 159 at the respective portion of the fold line 181, and a locking tab portion 189 foldably connected to the base portion 187 at a respective portion of the fold line 181. The locking tab portion 189 of the locking flap 179 can be separable from the attachment flap 159 at a cut 191 that includes one or more of straight, curved, and/or angled portions. In this regard, and as shown, the locking tab portion 189 of the locking flap 179 can include a generally straight free edge intersecting a generally oblique free edge.

Similarly, the second locking flap 183 can include a base portion 193 foldably connected to the attachment flap 163 at the respective portion of the fold line 185, and a locking tab portion 195 foldably connected to the base portion 193 at a respective portion of the fold line 185. The locking tab portion 195 of the locking flap 183 can be separable from the attachment flap 163 at a cut 197 that includes one or more of straight, curved, and/or angled portions. In this regard, and as shown, the locking tab portion 195 of the locking flap 183 can include a generally straight free edge intersecting a generally oblique free edge.

As described further herein, the locking flaps 179, 183 can form locking features of the blank 103/tray 105 for at least partially being received in corresponding locking features of the blank 303/sleeve 305.

It will be understood that the blank 103 and tray 105 formed therefrom can have a different number, arrangement, and/or configuration of panels and/or end flaps without departing from the disclosure.

Figure 2:
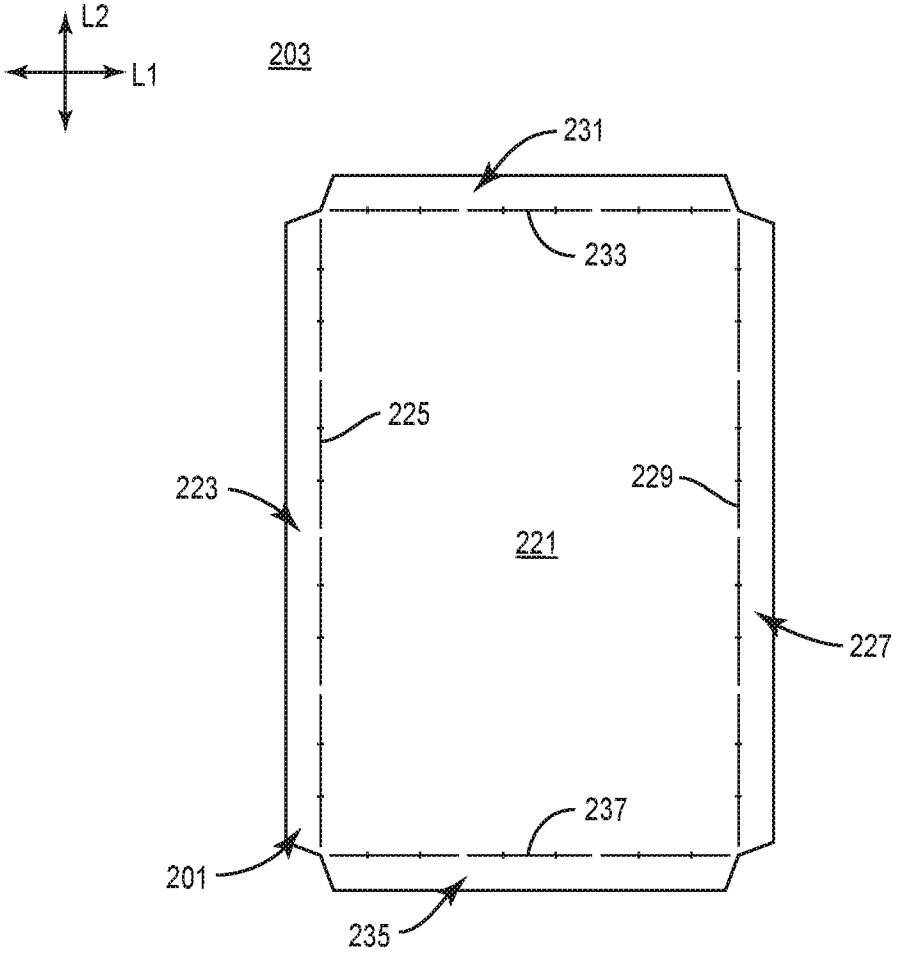
FIG. 2 is a plan schematic view of an insert blank for forming an insert according to an exemplary embodiment of the disclosure.

Turning to FIG. 2, an exterior surface 201 of an insert blank 203 for forming an insert 205 (FIG. 4) is illustrated. In some embodiments, the insert 205 can be at least partially received in the interior 107 of the tray 105.

The blank 203 can have the longitudinal axis L1 and the lateral axis L2. In some embodiments, the axes L1 and L2 can be transposed.

The blank 203 can have a bottom or central panel 221 and a plurality of end flaps foldably connected to the central panel 221. As shown, the plurality of end flaps can include a first side flap 223 foldably connected to the central panel 221 at a lateral fold line 225, a second side flap 227 foldably connected to the central panel 221 at a lateral fold line 229, a first end flap 231 foldably connected to the central panel 221 at a longitudinal fold line 233, and a second end flap 235 foldably connected to the central panel 221 at a longitudinal fold line 237.

As described further herein, the end flaps 223, 227, 231, 235 can be folded relative to the central panel 221 to form a plurality of legs or extensions for positioning the central panel at a selected vertical distance in the interior 107 of the tray 105.

It will be understood that the blank 203 and insert 205 formed therefrom can have a different number, arrangement, and/or configuration of panels and/or end flaps without departing from the disclosure.

Figure 3:
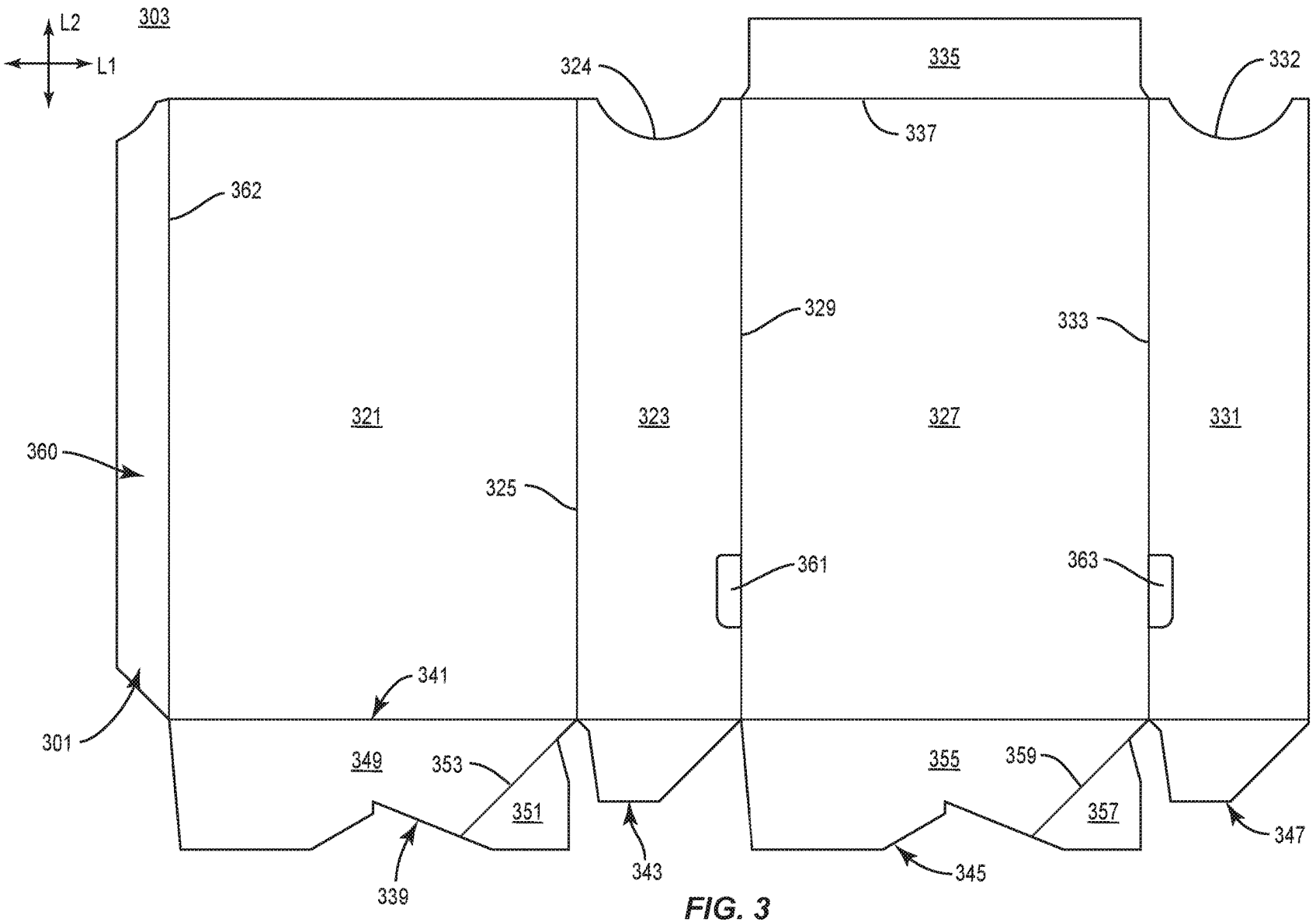
FIG. 3 is a plan schematic view of a sleeve blank for forming a sleeve according to an exemplary embodiment of the disclosure.

Turning to FIG. 3, an exterior surface 301 of a carton or sleeve blank 303 for forming a sleeve 305 (FIG. 4) is illustrated according to an exemplary embodiment of the disclosure.

The blank 303 can have the longitudinal axis L1 and the lateral axis L2. In some embodiments, the axes L1 and L2 can be transposed.

The blank 303 and tray 305 formed therefrom can have a plurality of panels for at least partially extending around an interior 307 of the tray 305 formed from the blank 303. The plurality of panels can include a bottom panel 321, a first side panel 323 foldably connected to the bottom panel 321 at a lateral fold line 325, a top panel 327 foldably connected to the first side panel 323 at a lateral fold line 329, and a second side panel 331 foldably connected to the top panel 327 at a lateral fold line 333. In the illustrated embodiment, the panels 323, 331 of the sleeve blank 303/sleeve 305 can define upper recessed free edges 324, 332 for facilitating user engagement with the system 100, as described further herein.

The blank 303 can include a plurality of end flaps foldably connected to a respective panel of the plurality panels. The plurality of end flaps can include a top end flap 335 foldably connected to the top panel 327 at a longitudinal fold line 337, a bottom end flap 339 foldably connected to the bottom panel 321 at a respective portion of a longitudinal fold line 341, a first side end flap 343 foldably connected to the side panel 323 at a respective portion of the fold line 341, a top end flap 345 foldably connected to the top panel 327 at a respective portion of the fold line 341, and a second side end flap 347 foldably connected to the side panel 331 at a respective portion of the fold line 341.

The end flap 339 can include a base portion 349 foldably connected to the bottom panel 321 at the respective portion of the fold line 341, and a distal portion 351 foldably connected to the base portion 349 at an oblique fold line 353.

Similarly, the end flap 345 can include a base portion 355 foldably connected to the bottom panel 327 at a respective portion of the fold line 341 and a distal portion 357 foldably connected to the base portion 355 at an oblique fold line 359.

An attachment flap 360 can be foldably connected to the bottom panel 321 at a lateral fold line 362.

The blank 303 and tray 305 formed therefrom can also include locking features for at least partially receiving corresponding locking features of the blank 103/tray 105. In the illustrated embodiment, the locking features can include a first locking opening 361 positioned at least partially in the side panel 323 and intersecting the fold line 329, and a second locking opening 363 positioned at least partially in the side panel 331 and at least partially intersecting the fold line 333.

It will be understood that the blank 303 and tray 305 formed therefrom can have a different number, arrangement, and/or configuration of panels and/or end flaps without departing from the disclosure.

With additional reference to FIG. 2, formation of the tray 105 from the tray blank 103, the insert 205 from the insert blank 203, and the sleeve 305 from the sleeve blank 303 will be described according to an exemplary embodiment of the disclosure. In this regard, the system 100 including at least the tray 105 and the sleeve 305 can be formed by first obtaining a combination of blanks.

The tray blank 103 can be positioned with the exterior surface 101 in contact with a supporting surface and an exterior surface thereof facing upwardly. The side panels 123, 127 can be folded at the fold lines 125, 129 into at least partial face-to-face contact with the bottom panel 121.

The distal portions 141, 145 of the side panel 123 can be folded back at the respective fold lines 143, 147 such that the exterior surfaces thereof are in at least partial face-to-face contact with the exterior surface of the base portion 139 of the side panel 123. Similarly, the distal portions 151, 155 of the side panel 137 can be folded back at the respective fold lines 153, 157 such that the exterior surfaces thereof are in at least partial face-to-face contact with the exterior surface of the base portion 149 of the side panel 127.

Simultaneously or thereafter, the attachment flaps 159, 163 can be folded at the fold lines 161, 165 into at least partial face-to-face contact with the end panel 131, and the attachment flaps 167, 171 can be folded at the fold lines 169, 173 into at least partial face-to-face contact with the end panel 135.

The end panel 131 can be folded at the fold line 133 into at least partial face-to-face contact with the bottom panel 121 such that the exterior surface of the attachment flap 159 carried thereon is positioned in at least partial face-to-face contact with the interior surface of the distal portion 141 of the side panel 123 and such that the exterior surface of the attachment flap 163 carried thereon is positioned in at least partial face-to-face contact with the interior surface of the distal portion 151 of the side panel 127.

Similarly, the end panel 135 can be folded at the fold line 137 into at least partial face-to-face contact with the bottom panel 121 such that the exterior surface of the attachment flap 167 carried thereon is positioned in at least partial face-to-face contact with the interior surface of the distal portion 145 of the side panel 123 and such that the exterior surface of the attachment flap 171 carried thereon is positioned in at least partial face-to-face contact with the interior surface of the distal portion 155 of the side panel 127.

The panels 123, 127, 131, 135 can then be folded at the respective fold lines 125, 129, 133, 137 into generally upright relation with the bottom panel 121. In such an arrangement, the attachment flap 159 can be in at least partial face-to-face contact with respective portions 139, 141 of the side panel 123, the attachment flap 163 can be in at least partial face-to-face contact with respective portions 149, 151 of the side panel 127, the attachment flap 167 can be positioned in at least partial face-to-face contact with respective portions 139, 145 of the side panel 123, and the attachment flap 171 can be positioned in at least partial face-to-face contact with respective portions 149, 155 of the side panel 127.

The locking flap 179 can be folded at the respective portion of the fold line 181 into generally spaced and parallel relation over the bottom panel 121, and the locking flap 183 can be folded at the respective portion of the fold line 185 into generally spaced and parallel relation of the bottom panel 121. The end flap 175 can also be folded at the fold line 177 into generally spaced and parallel relation over the bottom panel 121.

Such movement of the locking flaps 179, 183 can cause the locking tab portions 189, 195 thereof to separate from the respective attachment flaps 159, 163 at the respective cuts 191, 197 so as to be positioned extending away from the respective side panels 123, 127. In the illustrated embodiment, the respective locking portions 189, 195 of the respective locking flaps 179, 183 can extend away from the interior 107 of the tray 105, and the respective base portions 187, 193 of the respective locking flaps 179, 183 can extend toward the interior 107 of the tray 105, e.g., to at least partially overlie the interior 107 of the tray 105.

Figure 4:
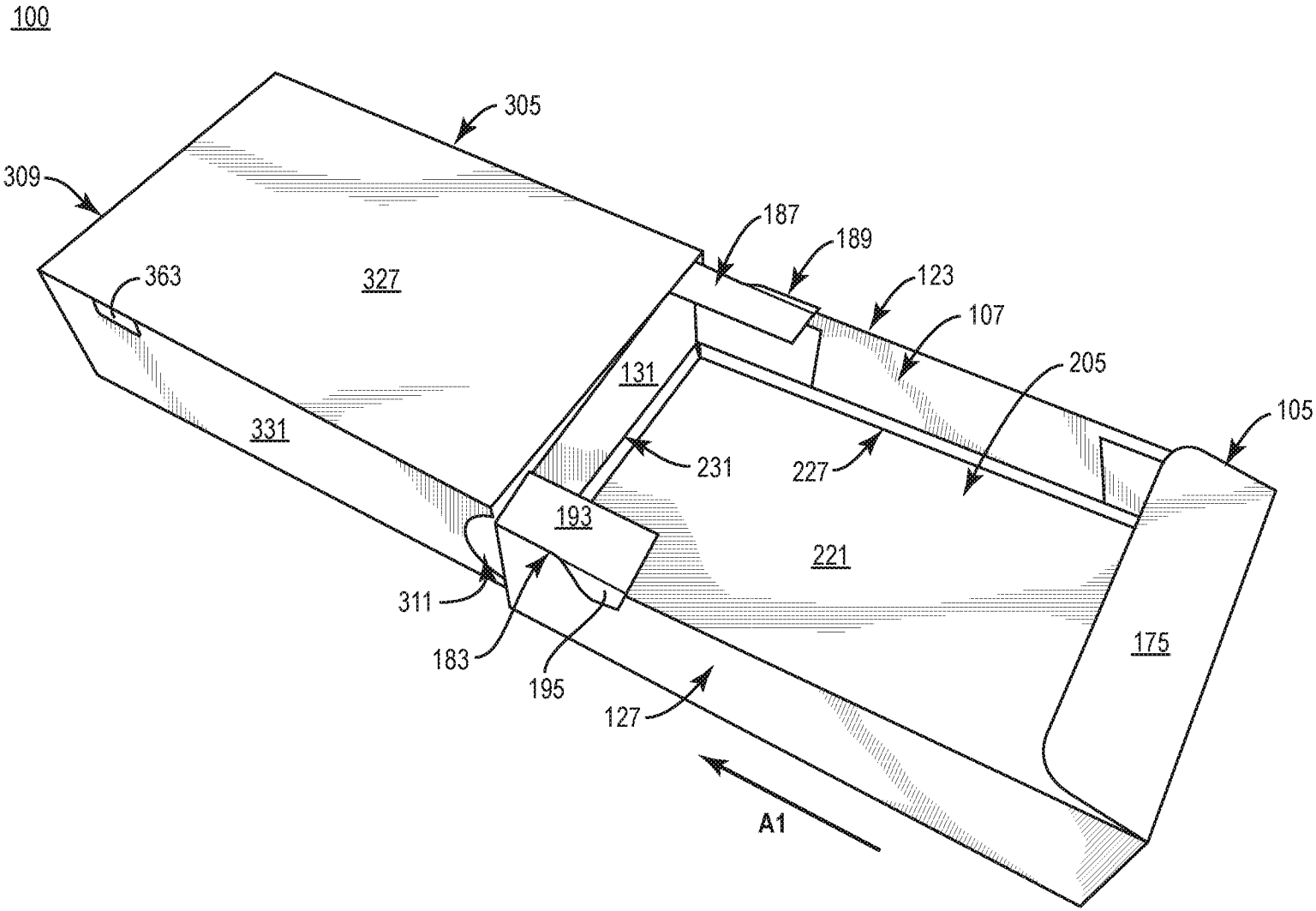
FIG. 4 is a perspective view of a system including a tray formed from the blank of FIG. 1 and a sleeve formed from the blank of FIG. 3 and in an open configuration according to an exemplary embodiment of the disclosure.

With continued reference to FIG. 4, the end flaps 223, 227, 231, 235 of the insert blank 203 can be folded at the respective fold lines 225, 229, 233, 235 into generally downwardly extending relation from the central panel 221 so as to form legs or extensions of the insert 205. The insert 205 can thus be positioned in the interior 107 of the tray 105, with the legs/extensions formed by the end flaps 223, 227, 231, 235 supporting the central panel 221 at a selected vertical distance from the bottom panel 121 of the tray 105.

It will be understood that such arrangement of the insert 205 can desirably support one or more articles above the bottom panel 121 of the tray 105, for example, to avoid contact with one or more uncoated/interior surfaces of the tray, to provide impact-resistant features, to take up empty space during shipping or other movement, etc. In this regard, it will be understood that the insert 205 can be selectively configured so as to provide a desired compartmented space within the interior 107 of the tray 105.

In some embodiments, the tray 105/system 100 can be provided without the insert 205, if desired.

Still referring to FIG. 4, according to one embodiment, the sleeve 305 can be formed from the blank 303 by positioning the interior surface 301 of the sleeve blank 303 on a supporting surface with an interior surface thereof facing upwardly.

The panels 321, 323, 327, 331 can be folded at the fold lines 325, 329, 333 to position the top panel 327 and the bottom panel 321 in generally spaced and parallel relation and to position the side panels 323, 331 in generally spaced and parallel relation, with the side panels 323, 331 extending perpendicularly from the top panel 327 to the bottom panel 321. The attachment flap 360 can be folded at the fold line 362 into at least partial face-to-face contact with the side panel 331. In such an arrangement, the panels 321, 323, 327, 331 extend at least partially around the interior 307 of the sleeve 305.

The end flaps 339, 343, 345, 347 can be folded at the respective portions of the fold line 341 into at least partial overlapping relation to form a closed end 309 of the sleeve 305. The end flap 335 can be folded at the fold line 337 into at least partial face-to-face contact with the interior surface of the top panel 327 at an open end 311 of the sleeve 305.

Figure 5:
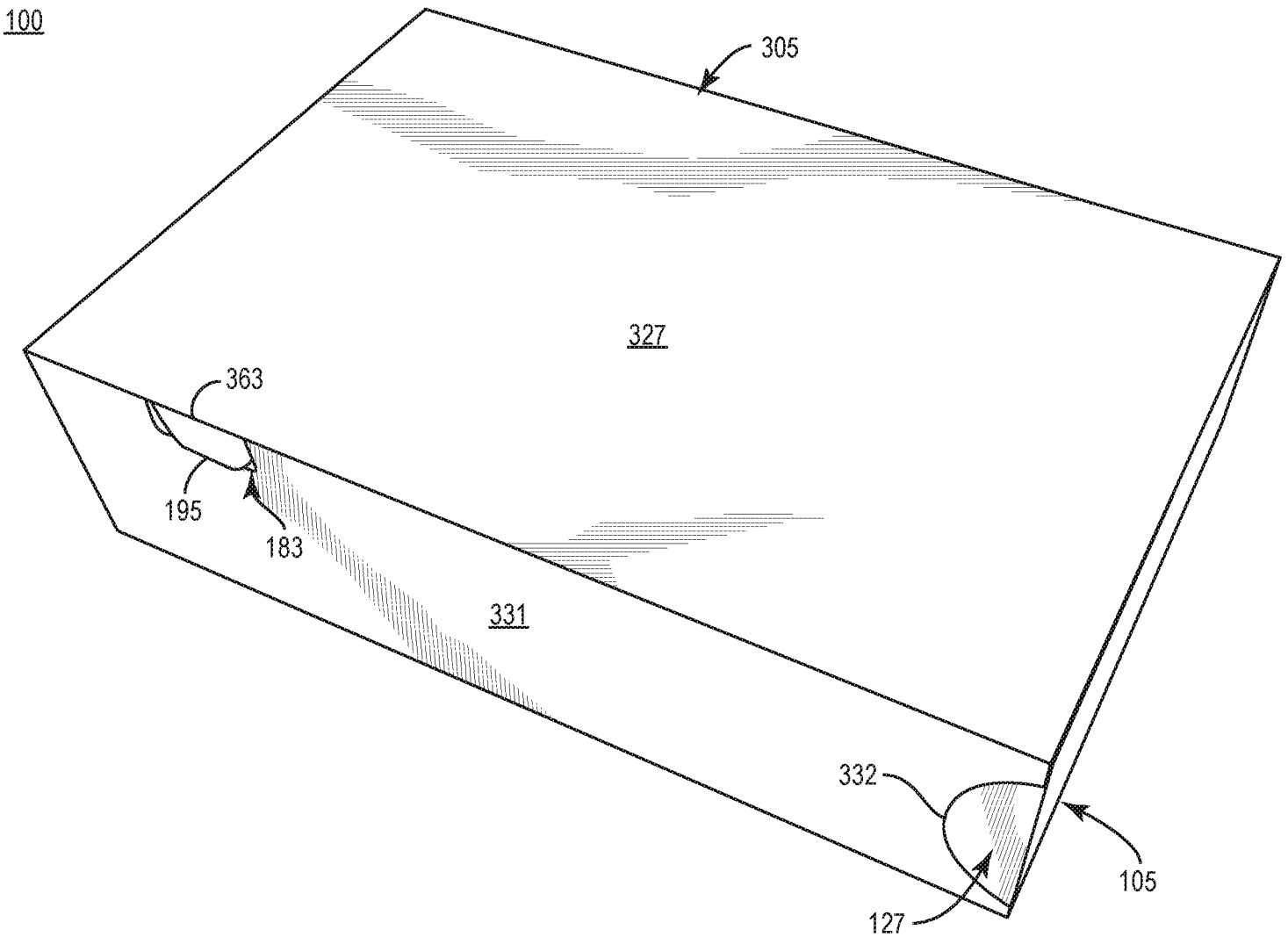
FIG. 5 is a perspective view of a system including a tray formed from the blank of FIG. 1 and a sleeve formed from the blank of FIG. 3 and in a closed configuration according to an exemplary embodiment of the disclosure.

With additional reference to FIG. 5, the tray 105 can be at least partially received in the open end 311 of the sleeve 305 and advanced in the direction A1 (FIG. 4) into the interior 307 of the sleeve 305. As the locking tab portions 189, 195 of the respective locking tabs 179, 183, which protrude away from the sides of the tray 105, contact the respective side panels 323, 331 of the sleeve 305, the respective locking tab portions 189, 195 can fold/flex at the respective fold lines 181, 185 at least partially downwardly and/or inwardly toward the respective side panels 123, 127 of the tray 105.

Upon further advancement of the tray 105 through the interior 307 of the sleeve 305 and toward the closed end 309 of the sleeve 305, the locking openings 361, 363 in the respective side panels 323, 331 of the sleeve 305 can provide a space through which the locking tab portions 189, 195 of the respective locking tabs 179, 183 of the tray 105 can extend outwardly. In this regard, the aforementioned folding of the respective locking tab portions 189, 195 at the respective fold lines 181, 185 toward the respective side panels 123, 127 of the tray 105 can introduce a bias tending to return the locking tab portions 189, 195 toward a generally outwardly extending arrangement from the respective side panels 123, 127.

As the locking tab portions 189, 195 of the respective locking flaps 179, 183 move to extend through the respective locking openings 361, 363, the locking tab portions 189, 195 can engage edges of the respective side panels 323, 331 that define the respective locking openings 361, 363 so as to at least partially maintain the position of the tray 105 inserted nearly fully or fully into the interior 307 of the sleeve 305. Accordingly, the engagement of the respective locking tab portions 189, 195 of the respective locking flaps 179, 183 with the side panels 323, 331 can maintain the tray 105 in a position in the interior 307 of the sleeve 305 such that the top panel 327 of the sleeve 305, in addition to the panels, 321, 323, 331, restrict access to the interior 107 of the tray 105 and the one or more articles held therein. Such an arrangement of the system 100, in which the locking tab portions 189, 195 of the respective locking flaps 189, 195 are at least partially received in the respective locking openings 361, 363, can be a closed or locked configuration of the system 100.

Figure 6:
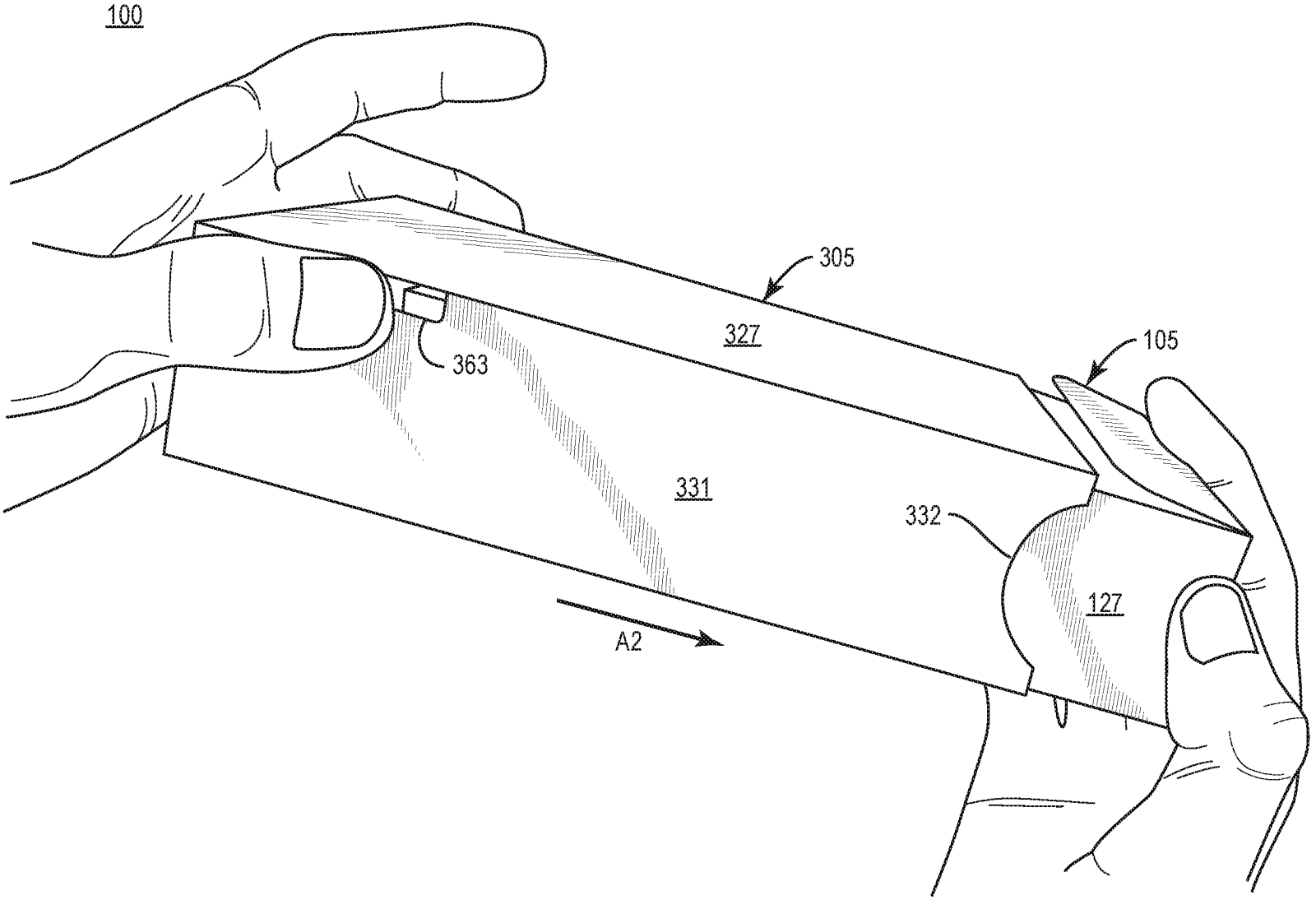
FIG. 6 is a perspective view illustrating a reconfiguration of the system of FIG. 5 from a closed configuration to an open configuration according to an exemplary embodiment of the disclosure.

As shown in FIG. 6, the system 100 can be opened/reconfigured from the closed/locked position to an open configuration by a user, according to some embodiments, by grasping the sleeve 305 with one hand, depressing the locking tab portions 189, 195 of the respective locking flaps 179, 183 at least partially through the respective locking openings 361, 363 to disengage the locking features of the tray 105/sleeve 305 and allow the tray 305 to freely slide along the interior 307 of the sleeve 305. In this regard, in some embodiments, the user can gasp one or more of the panels 321, 322, 327, 331 (and/or associated fold lines therebetween) and/or the closed end 309 of the sleeve 305 and engage the locking tab portions 189, 195 with selected fingers of said hand, e.g., the index finger and thumb, for example, to depress the locking tab portions 189, 195 of the locking flaps 19, 183 as described above.

Simultaneously or thereafter, a user can grasp the tray 105 with his or her other hand, for example, and withdraw the tray 105 at least partially from the sleeve 305 in the direction of the arrow A2 to at least partially expose the interior 107 of the tray 105 and allow access to one or more articles held therein. In some embodiments, portions of the side panels 123, 127 of the tray 105 exposed by the recessed edges 324, 332, of the sleeve blank 303/sleeve 305 can permit such initial engagement of the tray 105 when the system 100 is in a closed configuration, for example, between a user's index finger and thumb, for example.

The aforementioned system 100 provides a tray 105 and sleeve 305 in interlocking engagement to allow the system 100 to reconfigure between a closed/locked configuration, in which the locking tab portions 189, 195 of the respective locking flaps 189, 195 are at least partially received in the respective locking openings 361, 363, and an open configuration, in which the tray 105 is at least partially withdrawn from the interior 307 of the sleeve 305. The locking features described above can be configured such that intended user's having targeted physical characteristics are provided convenient access to open/unlock and close/lock the system 100 in a relatively easy manner, while users lacking such physical characteristics experience one or more barriers to at least opening/unlocking the system 100 and one or more articles in the interior 107 of the tray 105. In some embodiments, such physical characteristics can include the capability to grasp the tray 105/sleeve 305 with two hands simultaneously as described above and the dexterity to engage the locking features and at least partially withdraw the tray 105 from the sleeve 305 as described above.

It will be understood that one or more features of the system 100, tray 105, and/or sleeve 305 can have an alternative configuration without departing from the disclosure. For example, in some embodiments, the tray 105 and/or sleeve 305 can include a different number, arrangement, and/or configuration of locking features without departing from the disclosure.

In general, the blanks of the present disclosure may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A system for holding one or more articles, the system comprising: a tray comprising:

a plurality of panels at least partially extending around an interior of the tray, the plurality of panels comprising a bottom panel, two side panels, and two end panels;

a plurality of end flaps foldably connected to a respective panel of the plurality of panels of the tray; and locking features comprising at least one locking flap directly connected to a respective end flap of the plurality of end flaps, at least a portion of the at least one locking flap extending away from the tray; and a sleeve for at least partially receiving the tray, the sleeve comprising:

a plurality of panels extending at least partially around an interior of the sleeve, at least one panel of the plurality of panels of the sleeve comprising a locking opening for at least partially receiving the at least a portion of the at least one locking flap.

2. The system of claim 1, wherein the system is reconfigurable between a closed configuration, in which the at least a portion of the locking flap is at least partially received in the locking opening, and an open configuration, in which the tray is at least partially withdrawn from the interior of the sleeve.

3. The system of claim 2, wherein the at least one locking flap comprises a base portion and a locking portion foldably connected to the base portion, and the at least a portion of the at least one locking flap is the locking portion of the at least one locking flap.

4. The system of claim 3, wherein the base portion of the at least one locking flap extends toward the interior of the tray and the locking portion of the at least one locking flap extends away from the interior of the tray.

5. The system of claim 4, wherein the two side panels of the tray include a first side panel and a second side panel, the at least one locking flap is a first locking flap, the locking features further comprise a second locking flap foldably connected to a respective end flap of the plurality of end flaps of the tray, and at least a portion of the second locking flap extends away from the tray.

6. The system of claim 5, wherein the plurality of panels of the sleeve comprise a top panel, a bottom panel, a first side panel, and a second side panel, the at least one locking opening is a first locking opening in the first side panel of the sleeve for receiving the locking portion of the first locking flap when the system is in the closed configuration, and the locking features further comprise a second locking opening in the second side panel of the sleeve for at least partially receiving at least a portion of the second locking flap when the system is in the closed configuration.

7. The system of claim 6, wherein the plurality of end flaps of the tray comprises at least one attachment flap foldably connected to at least one of the two end panels, the at least one locking flap is foldably connected to the at least one attachment flap.

8. The system of claim 7, wherein the at least one attachment flap is positioned in at least partial face-to-face contact with the at least one of the two side panels of the tray.

9. The system of claim 4, wherein the sleeve comprises an open end, the plurality of panels of the sleeve comprises a top panel, a bottom panel, and at least one of the two side panels, the sleeve further comprises a plurality of end flaps foldably connected to a respective panel of the plurality of panels, and the plurality of end flaps of the sleeve are at least partially overlapped to form a closed end of the sleeve.

10. The system of claim 9, wherein the at least one side panel of the sleeve comprises a recessed free edge for exposing a portion of the tray when the system is in the closed configuration.

11. The system of claim 10, wherein the system further comprises an insert at least partially received in the interior of the tray, the insert comprising a central panel and a plurality of end flaps extending downwardly from the central panel to support the central panel of the insert above the bottom panel of the tray.

12. A combination of blanks for forming a system for holding one or more articles, the combination of blanks comprising:

a tray blank comprising:

a plurality of panels for at least partially extending around an interior of the tray formed from the tray blank, the plurality of panels comprising a bottom panel, two side panels, and at least one two end panels;

a plurality of end flaps foldably connected to a respective panel of the plurality of panels of the tray; and locking features comprising at least one locking flap directly connected to a respective end flap of the plurality of end flaps, at least a portion of the at least one locking flap for extending away from the tray formed from the blank; and a sleeve blank, the sleeve blank comprising:

a plurality of panels for extending at least partially around an interior of the sleeve formed from the sleeve blank for at least partially receiving the tray formed from the tray blank, at least one panel of the plurality of panels of the sleeve blank comprising a locking opening for at least partially receiving the at least a portion of the at least one locking flap.

13. The combination of blanks of claim 12, wherein at least a portion of the locking flap is for being at least partially received in the locking opening to form a closed configuration of the system formed from the combination of blanks.

14. The combination of blanks of claim 13, wherein the at least one locking flap comprises a base portion and a locking portion foldably connected to the base portion, and the at least a portion of the at least one locking flap is the locking portion of the at least one locking flap.

15. The combination of blanks of claim 14, wherein the base portion of the at least one locking flap is for extending toward the interior of the tray formed from the tray blank and the locking portion of the at least one locking flap is for extending away from the interior of the tray formed from the tray blank.

16. The combination of blanks of claim 15, wherein at least one of the two side panels of the tray is a first side panel, the plurality of panels of the tray further comprise a second side panel, the at least one locking flap is a first locking flap, the locking features further comprise a second locking flap foldably connected to a respective end flap of the plurality of end flaps of the tray, and at least a portion of the second locking flap is for extending away from the tray formed from the tray blank.

17. The combination of blanks of claim 16, wherein the plurality of panels of the sleeve blank comprises a top panel, a bottom panel, a first side panel, and a second side panel, the at least one locking opening is a first locking opening in the first side panel of the sleeve blank for receiving the locking portion of the first locking flap when the system formed from the combination of blanks is in the closed configuration, and the locking features further comprise a second locking opening in the second side panel of the sleeve blank for at least partially receiving at least a portion of the second locking flap when the system formed from the combination of blanks is in the closed configuration.

18. The combination of blanks of claim 17, wherein the plurality of end flaps of the tray comprises at least one attachment flap foldably connected to the at least one end panel, the at least one locking flap is foldably connected to the at least one attachment flap.

19. The combination of blanks of claim 15, wherein the plurality of panels of the sleeve blank comprises a top panel, a bottom panel, and at least one side panel, the sleeve blank further comprises a plurality of end flaps foldably connected to a respective panel of the plurality of panels of the sleeve blank, and the plurality of end flaps of the sleeve blank are arranged for being at least partially overlapped to form a closed end of the sleeve formed from the sleeve blank and an open end of the sleeve formed from the sleeve blank.

20. The combination of blanks of claim 19, wherein the at least one side panel of the sleeve blank comprises a recessed free edge for exposing a portion of the tray formed from the tray blank when the system formed from the combination of blanks is in the closed configuration.

21. The combination of blanks of claim 20, wherein the combination of blanks further comprises an insert blank for forming an insert for being at least partially received and a plurality of end flaps foldably connected to the central panel for extending downwardly from the central panel to support the central panel of the insert formed from the insert blank above the bottom panel of the tray formed from the tray blank.

22. A method of forming a system for holding one or more articles, the method comprising:

obtaining a tray blank comprising:

a plurality of panels comprising a bottom panel, two side panels, and two end panels;

a plurality of end flaps foldably connected to a respective panel of the plurality of panels of the tray; and locking features comprising at least one locking flap directly connected to a respective end flap of the plurality of end flaps;

obtaining a sleeve blank, the sleeve blank comprising a plurality of panels, at least one panel of the plurality of panels of the sleeve blank comprising a locking opening;

positioning the plurality of panels of the tray blank extending at least partially around an interior of the tray;

positioning the locking features of the tray blank such that at least a portion of the at least one locking flap extends away from the tray; and positioning the plurality of panels of the sleeve blank extending at least partially around an interior of the sleeve such that the interior of the sleeve is positioned for at least partially receiving the tray, and such that the locking opening is positioned for at least partially receiving the at least a portion of the at least one locking flap.

23. The method of claim 22, wherein the system is reconfigurable between a closed configuration, in which the at least a portion of the locking flap is at least partially received in the locking opening, and an open configuration, in which the tray is at least partially withdrawn from the interior of the sleeve.

24. The method of claim 23, further comprising at least partially inserting the tray into the interior of the sleeve and positioning the at least one locking flap extending through the at least one locking opening to form the closed configuration of the system.

25. The method of claim 24, further comprising pressing the at least one locking flap into the at least one locking opening and at least partially withdrawing the tray from the interior of the sleeve to form the open configuration of the system.

26. The method of claim 23, wherein the at least one locking flap comprises a base portion and a locking portion foldably connected to the base portion, and the at least a portion of the at least one locking flap is the locking portion of the at least one locking flap.

27. The method of claim 26, further comprising positioning the base portion of the at least one locking flap extending toward the interior of the tray and positioning the locking portion of the at least one locking flap extending away from the interior of the tray.

28. The method of claim 27, wherein at least one of the two side panels of the tray includes a first side panel and a second side panel, the at least one locking flap is a first locking flap, the locking features further comprise a second locking flap foldably connected to a respective end flap of the plurality of end flaps of the tray, and the method further comprises positioning at least a portion of the second locking flap extending away from the tray.

29. The method of claim 28, wherein the plurality of panels of the sleeve blank comprises a top panel, a bottom panel, a first side panel, and a second side panel, the at least one locking opening is a first locking opening in the first side panel of the sleeve for receiving the locking portion of the first locking flap when the system is in the closed configuration, and the locking features further comprise a second locking opening in the second side panel of the sleeve for at least partially receiving at least a portion of the second locking flap when the system is in the closed configuration.

30. The method of claim 29, wherein the plurality of end flaps of the tray comprises at least one attachment flap foldably connected to the at least one of the two end panels, the at least one locking flap is foldably connected to the at least one attachment flap.

31. The method of claim 30, further comprising positioning the at least one attachment flap in at least partial face-to-face contact with the at least one of the two side panels of the tray.

32. The method of claim 27, wherein positioning the plurality of panels of the sleeve blank comprises positioning the plurality of panels of the sleeve blank such that the sleeve comprises an open end, the plurality of panels of the sleeve blank comprises a top panel, a bottom panel, and at least one of the two side panels, the sleeve blank further comprises a plurality of end flaps foldably connected to a respective panel of the plurality of panels of the sleeve blank, and the method further comprises at least partially overlapping the plurality of end flaps of the sleeve blank to form a closed end of the sleeve.

33. The method of claim 32, wherein the of the two side panels of the sleeve blank comprises a recessed free edge for exposing a portion of the tray when the system is in the closed configuration.

34. The method of claim 33, further comprising obtaining an insert blank, the insert blank comprising a central panel and a plurality of end flaps foldably connected to the central panel, the method further comprises positioning the plurality of end flaps extending downwardly from the central panel to form an insert from the sleeve, and positioning the insert at least partially in the interior of the tray such that the plurality of end flaps extending downwardly from the central panel support the central panel of the insert above the bottom panel of the tray.

* * * * *